US009748087B2

(12) United States Patent
Kase et al.

(10) Patent No.: US 9,748,087 B2
(45) Date of Patent: Aug. 29, 2017

(54) SHORT ARC FLASH LAMP AND LIGHT SOURCE DEVICE

(71) Applicant: USHIO DENKI KABUSHIKI KAISHA, Tokyo (JP)

(72) Inventors: Masahiko Kase, Himeji (JP); Takayuki Hiraishi, Himeji (JP)

(73) Assignee: USHIO DENKI KABUSHIKI KAISHA, Tokyo (JP)

( * ) Notice: Subject to any disclaimer, the term of this patent is extended or adjusted under 35 U.S.C. 154(b) by 29 days.

(21) Appl. No.: 14/622,066

(22) Filed: Feb. 13, 2015

(65) Prior Publication Data

US 2015/0249003 A1 Sep. 3, 2015

(30) Foreign Application Priority Data

Feb. 28, 2014 (JP) ..... 2014-037844

(51) Int. Cl.

| | |
|---|---|
| ***H01J 61/00*** | (2006.01) |
| ***H01J 61/36*** | (2006.01) |
| ***H01J 61/90*** | (2006.01) |
| ***H01J 61/073*** | (2006.01) |
| ***H01J 61/54*** | (2006.01) |
| ***H01J 61/86*** | (2006.01) |

(52) U.S. Cl.

CPC ..... *H01J 61/366* (2013.01); *H01J 61/073* (2013.01); *H01J 61/545* (2013.01); *H01J 61/547* (2013.01); *H01J 61/86* (2013.01); *H01J 61/90* (2013.01)

(58) Field of Classification Search

CPC ..... H01J 61/54; H01J 61/025; H01J 61/063; H01J 61/90; H01J 61/366

USPC ..... 362/158, 263

See application file for complete search history.

(56) References Cited

U.S. PATENT DOCUMENTS

| | | | | |
|---|---|---|---|---|
| 9,153,428 | B2 * | 10/2015 | Kase | H01J 61/545 |
| 2005/0218823 | A1 * | 10/2005 | Dowe | G03B 15/05 315/200 R |
| 2012/0181924 | A1 * | 7/2012 | Ishikawa | H01J 5/38 313/594 |
| 2013/0099679 | A1 * | 4/2013 | Ikeda | H01J 61/54 315/183 |
| 2013/0229101 | A1 * | 9/2013 | Ikeda | H01J 61/54 313/5 |

(Continued)

FOREIGN PATENT DOCUMENTS

| | | | |
|---|---|---|---|
| JP | 2012094362 | A * | 5/2012 |
| JP | 5360033 | B2 | 12/2013 |

*Primary Examiner* — Sean Gramling
*Assistant Examiner* — Gerald J Sufleta, II
(74) *Attorney, Agent, or Firm* — Studebaker & Brackett PC

(57) ABSTRACT

Disclosed herein are a short arc type flash lamp having high lamp starting performance and capable of reducing the diameter of its seal tube part, and a light source device thereof. The flash lamp has an electrode shaft of one of the main electrodes, and an electrode shaft of the other of the main electrodes and leads for starting auxiliary electrodes which are respectively led out from the second seal tube part, and an external trigger is disposed in a state in which it extends in the circumferential direction on the outer peripheral surface of one end side region of the second seal tube part. The light source device is structured by a concave reflection mirror disposed on the second seal tube part side of the flash lamp in a state in which a focal point of the concave reflection mirror coincides with a luminous point of the flash lamp.

10 Claims, 10 Drawing Sheets

(56) References Cited

U.S. PATENT DOCUMENTS

2014/0233207 A1* 8/2014 Murai ..... G03B 15/05
362/16

* cited by examiner

SHORT ARC FLASH LAMP AND LIGHT SOURCE DEVICE

FIELD OF THE INVENTION

The present invention relates to a short arc type flash lamp and a light source device that has the short arc type flash lamp.

DESCRIPTION OF THE RELATED ART

Currently, as a light source for annealing by optical heating in manufacturing semiconductors, thin film transistors and the like, for example a long arc type flash lamp is commonly used.

Nevertheless, in a flash lamp, it is desirable to condense light or to form parallel light for example by a concave reflection mirror and other optical members and the like. In such a case, it is necessary that the distance between electrodes is made smaller to make a point light source.

FIG. 9 is a cross-sectional view along the tube axis direction showing an outline of a structure in one example of a conventional short arc type flash lamp.

This short arc type flash lamp is provided with a bulb 70 having an arc tube part 71 of an approximately elliptical spherical shape and seal tube parts 72, 75 which are continuous respectively from both ends of the arc tube part 71. Inside the arc tube part 71, a pair of main electrodes 80, 85 are arranged facing each other along the tube axis direction, and a pair of starting auxiliary electrodes 90, 91 and a sparker electrode (internal trigger) 95 also are arranged. The pair of main electrodes 80, 85 are held respectively at the tip portion of electrode shafts 81, 86 which extend air-tightly through the seal tube parts 72, 75 in the tube axis direction. The starting auxiliary electrodes 90, 91 are held respectively at the tip portion of internal leads 92. The internal leads 92 are electrically connected to external leads 94 which are air-tightly led out from a starting auxiliary electrode sealing part 76 via metal foil 93 which is air-tightly buried at the starting auxiliary electrode sealing part 76 formed on one seal tube part 75. Also, for example a xenon gas is enclosed within the arc tube part 71. A short arc type flash lamp having such a structure is disclosed for example in Japanese Patent No. 5360033B (Patent Literature 1).

And by arranging a concave reflection mirror composed for example of a parabolic mirror in a state in which its focal point coincides with a luminous point (light emitting point or bright spot) of the short arc type flash lamp, a light source device that irradiates light emitted from the short arc type flash lamp as parallel light can be composed.

LISTING OF REFERENCES

Patent Literature

Patent Literature 1: Japanese Patent No. 5360033

SUMMARY OF THE INVENTION

Problems to be Solved by the Invention

In general, a flash lamp is structured to have a starting auxiliary electrode which carries out preliminary discharge by being applied a predetermined voltage to generate charged particles that help discharge between the main electrodes. However, even if it has a structure with the starting auxiliary electrode, the actual situation is that it is not easy to ensure generation of stable main discharge.

In consideration of such circumstances, the above described short arc type flash lamp has a structure in which the sparker electrode 95 is provided in addition to the pair of starting auxiliary electrodes 90, 91 inside the bulb 70. However, when another electrode for the starting aid is arranged inside the bulb 70 as such, the seal tube part 75 necessarily becomes thick. As a result, it is necessary that an opening of the concave reflection mirror for inserting a lamp is made large when constructing a light source device, thus, it entails a problem that the light condensing efficiency of the concave reflection mirror is deteriorated.

Also, there is a case in which the lamp starting performance (startability) is deteriorated by the sparker electrode 95 shifting its position due to vibration generated by the flash lighting. Therefore, it is necessary that a support member 96 is disposed for holding the sparker electrode 95 within the bulb 70, but this also causes an undesired increase in diameter of the seal tube part 75.

Moreover, there is a problem that with an increase of the components to be disposed within the bulb, the lamp manufacturing process becomes complicated.

The present invention was made in view of the above mentioned circumstances and its object is to provide a short arc type flash lamp that has higher lamp startup performance and that can reduce the diameter of its seal tube part.

Another object of the present invention is to provide a light source device that allows the emitted light from the flash lamp to be emitted as parallel light and which can obtain high utilization rate of the light.

Solution to the Problem

According to a first aspect of the present invention, there is provided a short arc type flash lamp of a double end type. The short art type flash lamp includes a glass bulb having: an arc tube part; a first seal tube part extending outward along the tube axis direction to be continuous from one end of the arc tube part; and a second seal tube part extending outward along the tube axis direction to be continuous from the other end of the arc tube part. Inside the arc tube part, a pair of main electrodes are arranged facing each other, and a pair of starting auxiliary electrodes are arranged, and an electrode shaft of one of the main electrodes is led out air-tightly from the first seal tube part, and an electrode shaft of the other of the main electrodes and leads for the starting auxiliary electrodes respectively are led out air-tightly from the second seal tube part. An external trigger is disposed on the outer peripheral surface of one end side region of the second seal tube part in a state in which it extends in the circumferential direction.

According to a second aspect of the present invention, in the short arc type flash lamp, the second seal tube part may have a starting auxiliary electrode sealing part that is continuous to one end of the arc tube part via a space forming part for preliminary discharge; the external trigger is disposed on the outer peripheral surface of the space forming part for preliminary discharge; and a thickness of the space forming part for preliminary discharge is smaller than a thickness of the starting auxiliary electrode sealing part.

Moreover, according to a third aspect of the present invention, in the short arc type flash lamp, an outer diameter of the space forming part for preliminary discharge is smaller than an outer diameter of the starting auxiliary electrode sealing part.

According to a fourth aspect of the present invention, there is a provided a light source device. The light source device includes the above mentioned short arc type flash lamp and a concave reflection mirror formed with a parabolic mirror or an ellipsoidal reflection mirror, and the concave reflection mirror is disposed on the second seal tube part side of the short arc type flash lamp in a state in which a focal point of the concave reflection mirror coincides with a luminous point of the short arc type flash lamp.

Advantageous Effect of the Invention

According to the above mentioned aspects of the short arc type flash lamp of the invention, since the one end side region of the second seal tube part on which the external trigger is disposed has a straight tube shape, the external trigger can be secured (fixed) at an appropriate position. Thus, since it is possible to make sure that preliminary discharge including the discharge between the external trigger and the electrode shaft for the other main electrode occurs at a predetermined position, discharge between the main electrodes can be generated stably, and as a result, higher lamp starting performance (startability) can be obtained. Moreover, since it has a structure in which the trigger electrode for stably generating the discharge is disposed on the outside of the bulb, the second seal tube part can be made narrower. Therefore, when the light source device is constructed in combination with the concave reflection mirror, it is possible to prevent deterioration of the light condensing efficiency of the concave reflection mirror due to an enlarged size of the opening of the concave reflection mirror for inserting the lamp.

Further, since the generation position of the preliminary discharge between the external trigger and the electrode shaft for the other main electrode can be adjusted by suitably changing the disposing position of the external trigger, the external trigger can be easily disposed at an appropriate position. Moreover, since the internal structure of the second seal tube part itself can be simplified, it is possible to fabricate the short arc type flash lamp having intended performance easily.

Furthermore, preliminary discharge between the external trigger and the electrode shaft for the other main electrode can be generated even more easily. It is obtainable by making the structure such that the second seal tube part has the space forming part for preliminary discharge having a thickness that is smaller than the thickness of the starting auxiliary electrode sealing part at one end side that is continuous to the other end of the arc tube part, and the external trigger is disposed on an outer peripheral surface of the space forming part for preliminary discharge, and further by making the structure such that the outer diameter of the space forming part for preliminary discharge is made smaller than an outer diameter of the starting auxiliary electrode sealing part. Therefore, discharge can be generated in a stable manner between the main electrodes with a lower applied voltage between the main electrodes. As a result, even higher lamp starting performance can be obtained, and at the same time, longer lamp life can be achieved.

According to the light source device having such a short arc type flash lamp, the light emitted from the flash lamp can be emitted as the parallel light, and accordingly, higher utilization rate of light can be achieved.

These and other objects, aspects and advantages of the present invention will become apparent to those skilled in the art from the following detailed description when read and understood in conjunction with the appended claims and drawings.

DETAILED DESCRIPTION OF THE INVENTION

Hereinafter, embodiments of the invention will be explained in detail.

First Embodiment

Figure 1:
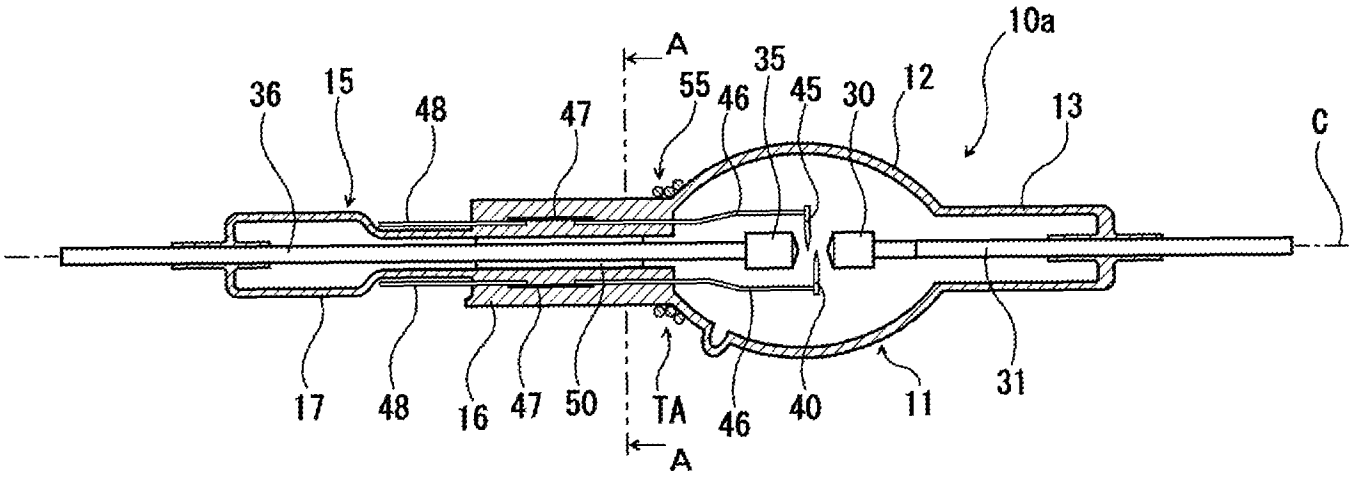
FIG. 1 is a cross-sectional view along the tube axis direction showing an outline of a structure in one example of a short arc type flash lamp according to a first embodiment of the present invention.
Figure 2:
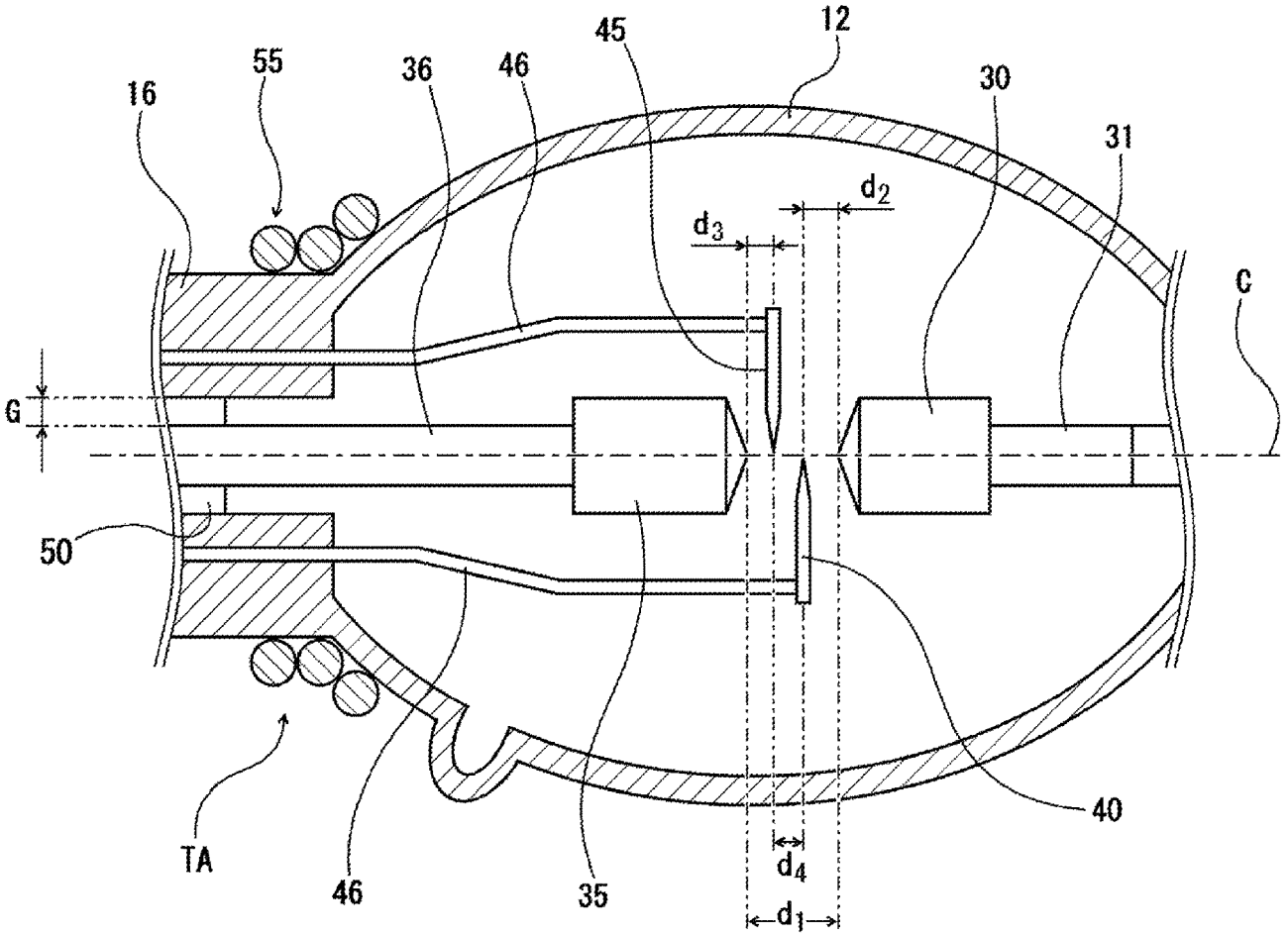
FIG. 2 is a partial enlarged view showing a principal part of the short arc type flash lamp as shown in FIG. 1.
Figure 3:
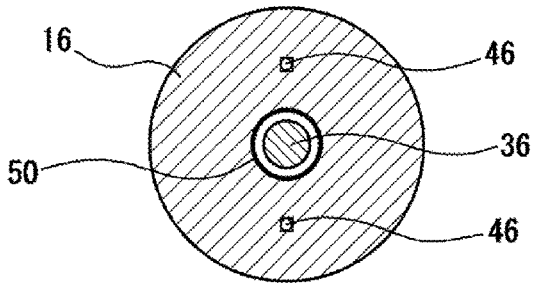
FIG. 3 is a sectional view taken along line A-A of FIG. 1.

FIG. 1 is a cross-sectional view along the tube axis direction showing an outline of a structure in one example of a short arc type flash lamp according to a first embodiment of the present invention. FIG. 2 is a partial enlarged view showing a principal part of the short arc type flash lamp as shown in FIG. 1. FIG. 3 is a sectional view taken along line A-A of FIG. 1.

The short arc type flash lamp (hereinafter simply referred to as a "flash lamp" also) 10*a* according to the first embodiment is the so-called double end type (i.e., both end sealing type). The flash lamp 10*a* is provided with a bulb 11 having an arc tube part 12 of for example an elliptical spherical shape which forms a light emitting space, a first seal tube part 13 which extends outward along the tube axis direction to be continuous from one end of the arc tube part 12, and a second seal tube part 15 which extends outward along the tube axis direction to be continuous from the other end of the arc tube part 12. The second seal tube part 15 has a starting auxiliary electrode sealing part 16 which is continuous from the other end of the arc tube part 12, and a main electrode sealing part 17 which is continuous from the starting auxiliary electrode sealing part 16. The starting auxiliary electrode sealing part 16 has a thickness that is thicker than the thickness of the arc tube part 12.

It should be noted that the "thickness" in the present embodiment indicates a thickness of the glass material, and indicates a thickness of the glass material in the radial direction unless otherwise specified.

Moreover, "the thickness of the second seal tube part 15" is considered by the thickness of the glass as a whole even if metal foil and a lead or the like are contained in a buried state.

Inside the arc tube part 12, an anode 30 and a cathode 35 as a pair of the main electrodes are arranged to be facing each other. Here, the distance $d_1$ between electrodes of the anode 30 and the cathode 35 is for example 1 to 10 mm.

The anode 30 is electrically connected to and held at the tip portion of a first electrode shaft (i.e., electrode core wire) 31 of a rod like shape which is arranged in an inserted state within the first seal tube part 13. The first electrode shaft 31 is sealed by stepped connection glass at the outer end portion of the first seal tube part 13, and its base end part is led out air-tightly from the first seal tube part 13.

The cathode 35 is electrically connected to and held at the tip portion of a second electrode shaft (i.e., electrode core wire) 36 of a rod like shape which is arranged in an inserted state within the second seal tube part 15. The second electrode shaft 36 is sealed by stepped connection glass at the outer end portion of the main electrode sealing part 17 at the second seal tube part 15, and its base end part is led out air-tightly from the second seal tube part 15.

The anode 30 is composed for example of tungsten.

The cathode 35 is composed for example of tungsten sintered compact in which easy electron emission material (emitter substance) such as barium oxide (BaO), calcium oxide (CaO), or alumina ($Al_2O_3$) is impregnated.

The first electrode shaft 31 and the second electrode shaft 36 are composed for example of tungsten.

The first electrode shaft 31 and the second electrode shaft 36 both of which are led out outward in the axial direction respectively from both ends of the bulb 11 are connected to a power feeder (not shown) having for example a plurality of (such as two) capacitors that are connected in parallel with each other. The pulse voltage is applied between the anode 30 and the cathode 35 by the capacitors being charged by application of a voltage between the anode 30 and the cathode 35.

Also, inside the arc tube part 12, a pair of starting auxiliary electrodes 40, 45 are arranged. Each of the starting auxiliary electrodes 40, 45 is formed for example in a thin linear shape, and is arranged such that its tip portion is spaced apart from one another on the central line that connects the tip end of the anode 30 and the tip end of the cathode 35.

Each of the starting auxiliary electrodes 40, 45 is electrically connected to and held at the tip portion of an internal lead 46 of a rod like shape which is arranged so as to extend along the tube axis inside the arc tube part 12. The base end part of each internal lead 46 is electrically connected to an external lead 48 which is led out from an outer end face of a starting auxiliary electrode sealing part 16 via a metal foil 47 which is air-tightly buried in the thick portion of the starting auxiliary electrode sealing part 16 in the second seal tube part 15. The metal foil 47 is arranged for example at locations opposite from one another with the central axis of the lamp (i.e., tube axis of the bulb 11) C therebetween.

The clearance $d_2$ between the tip portion of one starting auxiliary electrode 40 and the tip portion of the anode 30, and the clearance $d_3$ between the tip portion of the other starting auxiliary electrode 45 and the tip portion of the cathode 35 are for example 0.5 to 1.5 mm, respectively, when the distance $d_1$ between electrodes of the anode 30 and the cathode 35 is 3.0 mm.

Also, in the present embodiment, it is more efficient when discharge is carried out between electrodes with the same voltage after electrons are generated within the arc tube part 12 by an external trigger 55 which will be described below. Furthermore, it is preferable to arrange the respective tip portions at equal intervals such that the clearance $d_3$ between the tip portion of the cathode 35 and the tip portion of the other starting auxiliary electrode 45, the clearance $d_4$ between the tip portion of the other starting auxiliary electrode 45 and the tip portion of the one starting auxiliary electrode 40, and the clearance $d_2$ between the tip portion of the one starting auxiliary electrode 40 and the tip portion of the anode 30 have the same dimensions on the central axis of the lamp C.

Each of the starting auxiliary electrodes 40, 45 is composed for example of nickel, tungsten, or an alloy containing those, and the internal lead 46 and the external lead 48 are composed for example of tungsten.

Furthermore, an inert gas is enclosed within the arc tube part 12. As the inert gas, a xenon gas, a krypton gas, an argon gas, or mixture of those can be used.

The enclosing pressure of the inert gas is for example 0.1 to 1 MPa (1 to 10 atm), and preferably not less than 0.3 MPa (3 atm).

A buffer member 50 is disposed between the second electrode shaft 36 and the second seal tube part 15 to prevent adhesion of the second electrode shaft 36 and the second seal tube part 15 and at the same time to buffer (alleviate) the pressure due to thermal expansion. The buffer member 50 is composed for example by winding molybdenum foil a predetermined times around the outer circumference of the second electrode shaft 36. And the buffer member 50 abuts in a state that it presses the inner peripheral surface of the starting auxiliary electrode sealing part 16 by its own spring characteristic.

Meanwhile, in the above flash lamp 10*a*, an external trigger is arranged in a state in which it extends in the circumferential direction on the outer peripheral surface of one end side region of the second seal tube part 15.

The external trigger 55 of this example is composed by winding for example metal wire such as a Nichrome (nichrome) wire or a Kanthal (kanthal) wire on the outer peripheral surface of one end side region (i.e., border region with the arc tube part 12) of the starting auxiliary electrode sealing part 16 not less than one time around, for example, 2 to 15 times around in the circumferential direction with respect to the tube axis of the bulb 11. In general, since variation may occur in the degree of contact between the external trigger 55 and the second seal tube part 15 and in the inclination of the second electrode shaft 36 and the like. Thus, the distance between the external trigger 55 and the second electrode shaft 36 is not always constant. Taking those findings into consideration, in the present embodiment, by winding the metal wire one or more times around in the circumferential direction, it is possible to reliably generate discharge between the external trigger 55 and the second electrode shaft 36 at a position where the metal wire firmly contacts the second seal tube part 15 most and where the clearance between the metal wire and the second electrode shaft 36 is small. Accordingly, it is possible to generate charged particles stably.

Here, the dimension G of the gap between the inner peripheral surface of the starting auxiliary electrode sealing part 16 and the outer peripheral surface of the second electrode shaft 36 at the region where the external trigger is arranged (external trigger arrangement area TA) is for example 2 to 5 mm.

Also, as such, when the external trigger 55 is arranged at the external trigger arrangement area TA which is at a position outward of the cathode 35 along the tube axis, it is possible to make sure the preliminary discharge with the external trigger 55 occurs between the external trigger 55 and the second electrode shaft 36. Thus, it does not cause evaporation of the emitter more than necessary due to an unintentional occurrence of discharge with the cathode 35 that contains the emitter. Accordingly, an effect of extending life of the cathode 35 can be achieved also.

In other words, it can be said that such an effect is peculiar to a short arc type flash lamp having a structure in which, as in the present embodiment, the external trigger 55 is not suspended at the region between the main electrodes where the main discharge occurs (between the cathode 35 and the anode 30) and the starting auxiliary electrode is provided.

The above mentioned flash lamp 10*a* can be fabricated for example as follows.

Figure 4A:
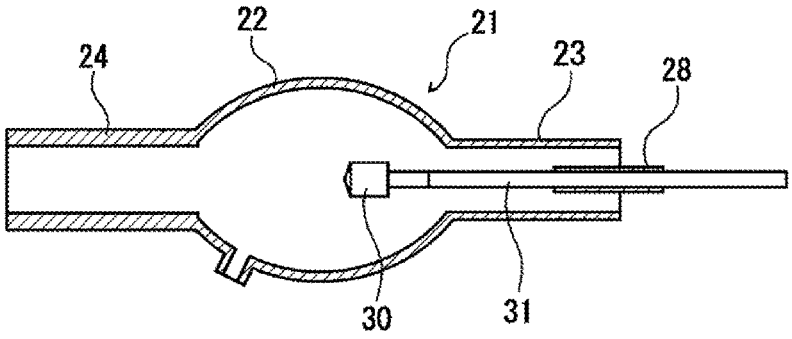
FIGS. 4A to 4D are cross-sectional views showing an outline of manufacturing processes of the short arc type flash lamp as shown in FIG. 1.

First, as shown in FIG. 4A, a glass tube 21 is provided that has a swelling (tube swelling) part 22 for forming the arc tube part 12, a straight tube part 23 for forming the first seal tube part which is continuous from one end of the swelling part 22, and a straight tube part 24 for forming the starting auxiliary electrode part which is continuous from the other end of the swelling part 22. And the first electrode shaft 31 having the anode 30 on its tip portion is arranged so as to be inserted through the straight tube part 23 for forming the first seal tube part such that its one end protrudes. The reference number 28 in FIG. 4A denotes a sealing member made for example of a material having a linear thermal expansion coefficient that is in the middle between the expansion coefficient of the glass tube 21 and the expansion coefficient of the first electrode shaft 31 (such as low melting point glass). In this state, the first seal tube part 13 is formed by sealing the end portion of the straight tube part 23 for forming the first seal tube part by, for example, the graded sealing method, and thus an anode side structure (mount) is prepared.

Figure 4B:
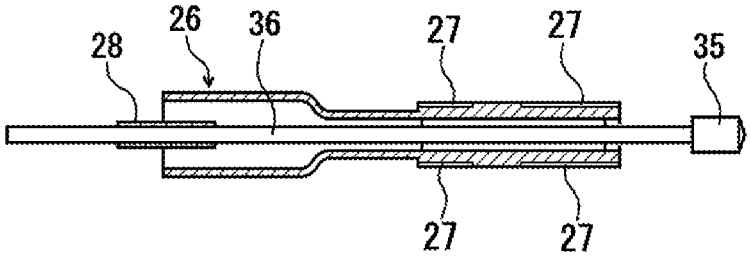

Also, as shown in FIG. 4B, a glass tube 26 for forming the second seal tube part with a reduced diameter at one end side portion in a straight tube shape is provided, and the second electrode shaft 36 having the cathode 35 on its tip portion is arranged so as to be inserted therethrough. The reference number 28 in FIG. 4B denotes a sealing member made for example of a material having a linear thermal expansion coefficient that is in the middle between the expansion coefficient of the glass tube 21 and the expansion coefficient of the second electrode shaft 36 (such as low melting point glass). In this state, the other end part of the glass tube 26 for forming the second seal tube part is sealed by, for example, the graded sealing method.

Figure 4C:
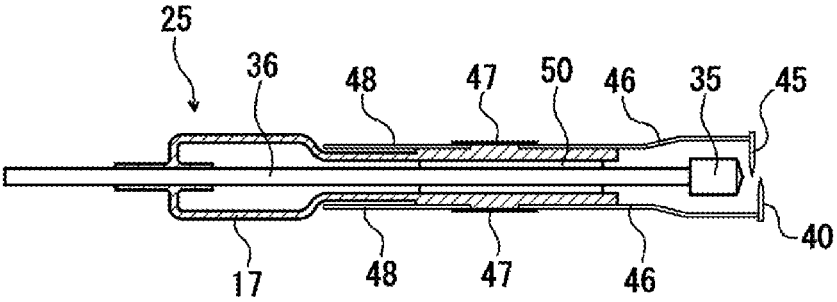

Subsequently, as shown in FIG. 4C, the internal leads 46 having the starting auxiliary electrodes 40, 45 on their tip portions, respectively, and the external leads 48, both of which are electrically connected with each other through the metal foil 47, are supported and fixed on the outer peripheral surface of the one end side part at the reduced diameter part of the glass tube 26 for forming the second seal tube part. Further, by inserting the buffer member 50 which is made tubular for example by rolling the molybdenum foil with respect to the second electrode shaft 36, the second electrode shaft 36 is arranged with the buffer member 50 abutting in a state that the inner peripheral surface of the glass tube 26 for forming the second seal tube part is pressed by the spring characteristics of the buffer member 50 itself, and thus, a cathode side structure (mount) 25 is prepared. Here, the internal leads 46 and the external leads 48 are accommodated in lead arrangement grooves 27 formed so as to extend in the axial direction on the outer peripheral surface of the glass tube 26 for forming the second seal tube part, respectively.

Figure 4D:
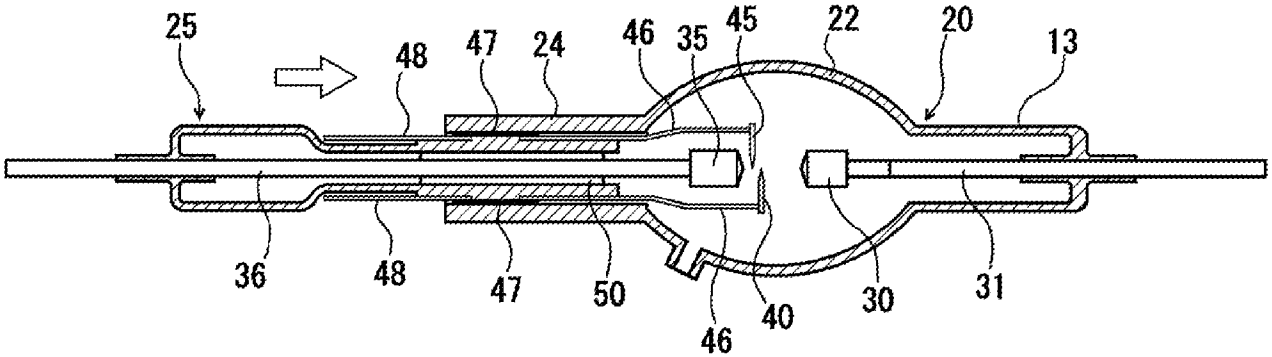

Yet subsequently, as shown in FIG. 4D, one end part of the cathode side structure 25 is inserted into and arranged in an opening of the straight tube part 24 for forming the starting auxiliary sealing electrode part of an anode side structure 20 in a state that one end face of the glass tube 26 for forming the second seal tube part is positioned in the plane where the boundary surface of the swelling part 22 and the straight tube part 24 for forming the starting auxiliary sealing electrode part of the anode side structure 20 is positioned. In this state, by welding the inner peripheral surface of the straight tube part 24 for forming the starting auxiliary electrode sealing part and the outer peripheral surface of the cathode side structure 25, the second seal tube part 15 is formed, and at the same time, the metal foil 47 for the starting auxiliary electrodes 40, 45 is air-tightly sealed.

Subsequently, the external trigger 55 is formed by winding and providing a metal wire at the one end side region of the second seal tube part 15, and a predetermined gas (such as the Xe gas) of a predetermined amount is enclosed within the arc tube part 12, and thus, the flash lamp 10*a* as shown in FIG. 1 can be obtained.

In the above mentioned flash lamp 10*a*, when a voltage of a predetermined magnitude is applied by a lighting circuit, not shown, preliminary discharge occurs between the anode 30 and the cathode 35, between the anode 30 and the one starting auxiliary electrode 40, between the cathode 35 and the other starting auxiliary electrode 45, and between the pair of starting auxiliary electrodes 40, 45, respectively. In other words, first, discharge occurs between the external trigger 55 and the second electrode shaft 36, more specifically, at the gap (the annular aperture) between the inner peripheral surface of the starting auxiliary electrode sealing part 16 and the outer peripheral surface of the second electrode shaft 36 in the trigger arrangement area TA. And then charged particles are generated inside the arc tube part 12. Subsequently, after the discharge has occurred between the cathode 35 and the other starting auxiliary electrode 45, the discharge occurs between the other starting auxiliary electrode 45 and the one starting auxiliary electrode 40. Thereafter, the discharge occurs between the one starting auxiliary electrode 40 and the anode 30.

By such preliminary discharge, a preliminary discharge path is formed between the anode 30 and the cathode 35, and electrons are emitted from the cathode 35 toward the anode 30. Accordingly, the arc discharge (main discharge) is generated between the cathode 35 and the anode 30, thus lighting the flash lamp 10*a*.

The flash lamp 10*a* can be used in combination with for example a concave reflection mirror.

Figure 5:
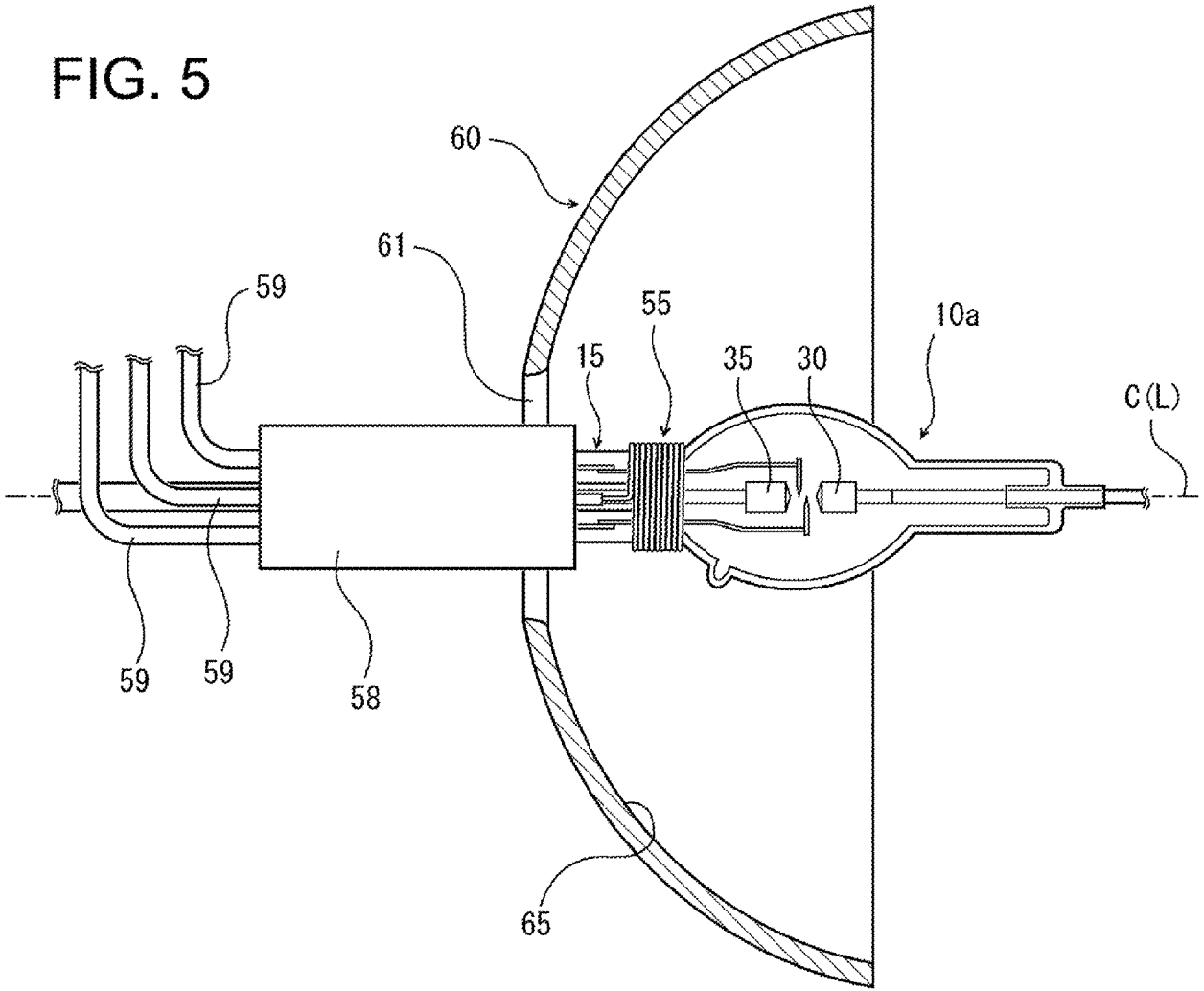
FIG. 5 is a cross-sectional view showing an outline of a structure in one example of a light source device according to an embodiment of the invention.

FIG. 5 is a cross-sectional view showing an outline of a structure in one example of a light source device of the present embodiment.

This light source device is provided with the above mentioned flash lamp 10*a*, and a concave reflection mirror 60 arranged at the second seal tube part 15 side of the flash lamp 10*a* so as to surround the periphery of the arc tube part 12 of the flash lamp 10*a*.

A bottomed cylindrical base (or cap, hereinafter referred to as "base") 58 made for example of aluminum is adhered by an adhesive and provided at the second seal tube part 15 of the flash lamp 10*a*. Also, the external lead 48 of each of the starting auxiliary electrodes 40, 45 and the end portion of the external trigger 55 which extends linearly in the axial direction along the second seal tube part 15 are positioned inside the base 58. At the end portion of the external trigger 55, an insulating member (not shown) such as heat-shrinkable tubing is provided for preventing short circuit. Further, three wires (feeder wires) 59 provided at the base 58 are respectively connected to the external lead 48 of each of the starting auxiliary electrodes 40, 45 and the external trigger 55, and are configured to be individually feedable.

The concave reflection mirror 60 is composed of a parabolic mirror (parabola mirror) on which an opening for lamp insertion 61 is formed at its top section, and reflection surface 65 is configured by forming derivative multilayer reflection film (not shown) in which for example titania and silica are laminated on the interior surface thereof.

The concave reflection mirror 60 is arranged in a state in which the second seal tube part 15 of the flash lamp 10*a* is inserted in the opening for lamp insertion 61; the optical axis L coincides with the lamp central axis C of the flash lamp 10*a*; and the focal position coincides with the center (central) location between the electrodes of the anode 30 and the cathode 35 (luminous point).

In this light source device, the light emitted from the flash lamp 10*a* is reflected by the reflection surface 65 of the concave reflection mirror 60 that is made for example with a parabolic mirror, by which it is emitted as parallel light along the optical axis of the parabolic mirror.

Also, an ellipsoidal reflection mirror may be used as the concave reflection mirror 60, and in that case, a suitable optical member (not shown) may be disposed on the forward side of the light emitting direction, and the light emitted from the ellipsoidal reflection mirror while being condensed can be made to be parallel light by such an optical member.

Furthermore, according to the flash lamp 10*a* configured as described above, since the one end side region of the second seal tube part 15 on which the external trigger 55 is disposed has a straight tube shape, the external trigger 55 can be secured (fixed) at an appropriate position. Thus, since it is possible to make sure that preliminary discharge including the discharge between the external trigger 55 and the second electrode shaft 36 occurs at a predetermined position, discharge between the main electrodes of the anode 30 and the cathode 35 can be generated stably. As a result, higher lamp starting performance (startability) can be obtained. Moreover, since it has a structure in which the trigger electrode for stably generating the discharge is provided on the outside of the bulb 11, the second seal tube part 15 can be made narrower. Therefore, when the light source device is configured in combination with the concave reflection mirror, it is possible to prevent deterioration of the light condensing efficiency of the concave reflection mirror 60 due to an enlarged size of the opening for lamp insertion 61 of the concave reflection mirror 60.

Further, since the generation location of the preliminary discharge between the external trigger 55 and the second electrode shaft 36 can be adjusted by suitably changing the disposed position of the external trigger 55, the external trigger 55 can be easily disposed at an appropriate location. Moreover, since the internal structure of the second seal tube part 15 itself (such as a structure of the cathode side structure 25) can be simplified, it is possible to fabricate the flash lamp 10*a* having intended performance easily.

When the trigger electrode is disposed inside the bulb, unless its position is kept from the beginning of the lighting to the end, there is a risk that the stability of light emission (luminous stability) may be deteriorated by an occurrence of a phenomenon such as discharge at a location other than a predetermined location, and the trigger electrode may be heated and evaporated by the discharge and the bulb may become blackened. Thus, it is necessary that the trigger electrode is arranged with high accuracy, and as the material that constitutes the trigger electrode, it becomes also necessary that parts made of tungsten or the like which is costly and difficult to process are used.

On the other hand, as in the present embodiment, by employing a structure in which the trigger electrode (the external trigger 55) is arranged outside of the bulb 11, positions of the trigger electrode can be easily adjusted, and further, since the operation temperature of the arranged location is considerably lower than the inside of the bulb 11, it is possible to use the Kanthal wire, the Nichrome wire and the like which are relatively low priced and easier to process. In this regard also, it is possible that an intended flash lamp is to be fabricated advantageously.

According to the light source device having such a flash lamp 10*a*, since the flash lamp 10*a* becomes closer to a point light source, it is possible to make sure that the light emitted from the flash lamp 10*a* (such as light in the wavelength region of 200 nm or less) is made to be parallel light that is parallel to the optical axis of the concave reflection mirror 60 by the concave reflection mirror 60 and the optical member used as needed, and thus, higher utilization rate of light can be achieved.

Second Embodiment

Figure 6:
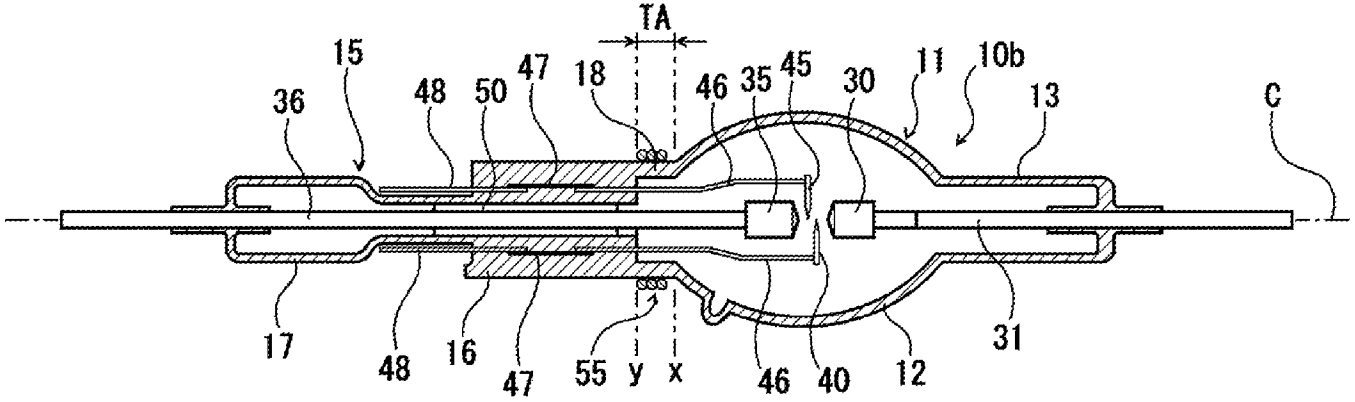
FIG. 6 is a cross-sectional view along the tube axis direction showing an outline of a structure in one example of a short arc type flash lamp according to a second embodiment of the present invention.

FIG. 6 is a cross-sectional view along the tube axis direction showing an outline of a structure in one example of a short arc type flash lamp according to a second embodiment of the present invention.

The flash lamp 10*b* has the similar structure as the flash lamp 10*a* according to the first embodiment except that in the flash lamp 10*a* according to the first embodiment as shown in FIGS. 1 to 3, the thickness of the external trigger arrangement area TA at the second seal tube part 15 of the bulb 11 on which the external trigger 55 is disposed is made smaller than the thickness of the starting auxiliary electrode sealing part 16.

In the flash lamp 10*b*, the starting auxiliary electrode sealing part 16 of the second seal tube part 15 of the bulb 11 is being continuous from one end of the arc tube part 12 via a space forming part for preliminary discharge 18, and one end face of the starting auxiliary electrode sealing part 16 (location y) is located outward of the other end face of the arc tube part 12 (location x). Further, the space forming part for preliminary discharge 18 is made as the external trigger arrangement area TA in which the external trigger 55 is disposed on the outer peripheral surface of the space forming part for preliminary discharge 18.

The thickness of the space forming part for preliminary discharge 18 has a dimension that is for example similar to the thickness of the arc tube part 12, and the dimension of the annular aperture between the inner peripheral surface of the space forming part for preliminary discharge 18 and the outer peripheral surface of the second electrode shaft 36 may be for example 8 to 15 mm. Further, the length of the space forming part for preliminary discharge 18 in the axial direction may be for example 5 to 15 mm.

Such a flash lamp 10*b* can be obtained by adjusting the degree of insertion of the one end part of the cathode side structure 25 with respect to the opening of the straight tube part 24 for forming the starting auxiliary electrode sealing part of the anode side structure 20 in the above mentioned manufacturing method of the flash lamp 10*a*. Thus, the space forming part for preliminary discharge 18 is formed by a portion of the straight tube part 24 for forming the starting auxiliary electrode sealing part of the anode side structure 20 and become to have a thickness similar to that of the arc tube part 12.

In this flash lamp 10*b*, when a voltage of a predetermined magnitude is applied between the main electrodes of the anode 30 and the cathode 35, between the anode 30 and the one starting auxiliary electrode 40, between the cathode 35 and the other starting auxiliary electrode 45, and between the pair of starting auxiliary electrodes 40, 45, respectively, by a lighting circuit, not shown, as described above, first, discharge occurs between the external trigger 55 and the second electrode shaft 36, more specifically, at the annular aperture between the inner peripheral surface of the space forming part for preliminary discharge 18 and the outer peripheral surface of the second electrode shaft 36, and thus charged particles are generated inside the arc tube part 12.

In this regard, according to the flash lamp 10*b* of the above mentioned structure, preliminary discharge between the external trigger 55 and the second electrode shaft 36 can be generated even more easily. Thus, as shown in the results of the empirical examples, which will be described below, discharge between the main electrodes of the anode 30 and the cathode 35 can be generated with a lower applied voltage between the main electrodes. Accordingly, even higher lamp starting performance (startability) can be obtained, and at the same time, longer lamp life can be achieved.

Third Embodiment

Figure 7:
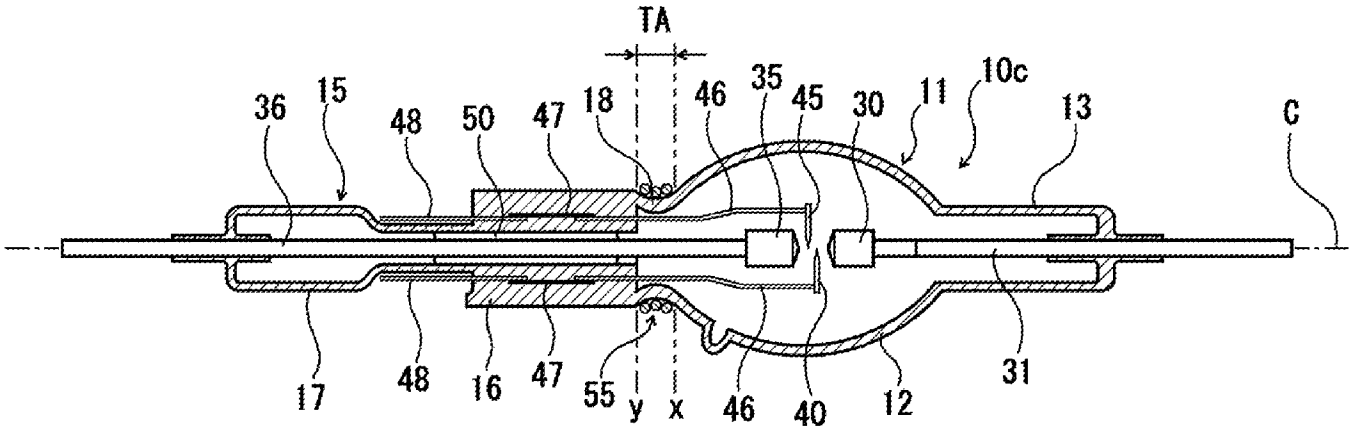
FIG. 7 is a cross-sectional view along the tube axis direction showing an outline of a structure in one example of a short arc type flash lamp according to a third embodiment of the present invention.

FIG. 7 is a cross-sectional view along the tube axis direction showing an outline of a structure in one example of a short arc type flash lamp according to a third embodiment of the present invention.

The flash lamp 10*c* has the similar structure as the flash lamp 10*b* according to the second embodiment except that in the flash lamp 10*b* according to the second embodiment as shown in FIG. 6, the outer diameter of the space forming part for preliminary discharge 18 is configured to be smaller than the outer diameter of the starting auxiliary electrode sealing part 16.

In this flash lamp 10*c*, the space forming part for preliminary discharge 18 that constitutes the external trigger arrangement area TA at the second seal tube part 15 of the bulb 11 has its diameter reduced inward in the radial direction in its whole circumference, and the dimension of the gap (width) between the inner peripheral surface of the space forming part for preliminary discharge 18 and the outer peripheral surface of the second electrode shaft 36 is configured to be smaller than that of the flash lamp 10*b* according to the second embodiment.

The dimension of the gap between the inner peripheral surface of the space forming part for preliminary discharge 18 and the outer peripheral surface of the second electrode shaft 36 may be for example 3 to 7 mm.

Such a flash lamp 10*c* can be obtained by forming the space forming part for preliminary discharge 18 configured with a portion of the straight tube part 24 for forming the starting auxiliary electrode sealing part of the anode side structure 20 by adjusting the degree of insertion of the one end part of the cathode side structure 25 with respect to the opening of the straight tube part 24 of the anode side structure 20 in the above mentioned fabricating method of the flash lamp 10*a*, and further by heat shrinking the space forming part for preliminary discharge 18.

In this flash lamp 10*c*, when a voltage of a predetermined magnitude is applied between the main electrodes of the anode 30 and the cathode 35, between the anode 30 and the one starting auxiliary electrode 40, between the cathode 35 and the other starting auxiliary electrode 45, and between the pair of starting auxiliary electrodes 40, 45, respectively, by a lighting circuit, not shown, as described above, first, discharge occurs between the external trigger 55 and the second electrode shaft 36, more specifically, at the annular aperture between the inner peripheral surface of the space forming part for preliminary discharge 18 and the outer peripheral surface of the second electrode shaft 36, and thus charged particles are generated inside the arc tube part 12.

In this regard, according to the flash lamp 10*c* of the above described structure, the external trigger 55 can be secured (fixed) in an assured manner at an appropriate position. Yet furthermore, since the clearance between the external trigger 55 and the second electrode shaft 36 becomes smaller, preliminary discharge between the external trigger 55 and the second electrode shaft 36 can be generated even more easily, and as shown in the results of the empirical examples which will be described below, discharge between the main electrodes of the anode 30 and the cathode 35 can be generated with a lower applied voltage between the main electrodes, and even higher lamp startup performance (startability) can be obtained, and at the same time, longer lamp life can be achieved.

EXAMPLES

Hereinafter, specific examples of the flash lamp according to the present embodiments will be explained. However, it should be noted that the present invention is not limited to these particular examples.

Example 1

The short arc type flash lamp according to the first embodiment of the present invention (hereinafter referred to as "flash lamp A") was fabricated according to the structure as shown in FIGS. 1 to 3. Specifications of this flash lamp A are as shown below.

<Arc Tube Part 12>

Material: quartz glass; Outer diameter: ϕ 20 mm; Thickness: 2 mm

<First Seal Tube Part 13>

Outer diameter: ϕ 8 mm; Length: 12 mm; Thickness: 2 mm

<Second Seal Tube Part 15>

Outer diameter of the starting auxiliary electrode sealing part 16: 12 mm; Length: 20 mm; Thickness 5 mm Outer diameter of the main electrode sealing part 17: 10 mm; Length: 15 mm; Thickness: 2 mm <Anode 30>

Material: tungsten; Maximum outer diameter: ϕ 4 mm

<Cathode 35>

Material: BaO-based oxide (emitter substance) impregnated tungsten; Maximum outer diameter: ϕ 4 mm <First Electrode Shaft 31; Second Electrode Shaft 36>

Material: tungsten; Outer diameter: ϕ 2 mm

<Starting Auxiliary Electrodes 40, 45>

Material: tungsten; Outer diameter: ϕ 0.5 mm

<Internal Lead 46; External Lead 48>

Material: tungsten; Outer diameter: ϕ 0.5 mm

<Metal Foil 47>

Material: molybdenum; Thickness: 20 μm; Width: 1.5 mm

<Buffer Member 50>

Molybdenum foil of thickness 20 μm being wound twice; Length in the axial direction: 12 mm <External Trigger 55>

Constructed by winding the Kanthal wire having outer diameter of ϕ 0.32 mm about 10 times around Dimension of the gap (G) between the inner peripheral surface of the starting auxiliary electrode sealing part and the outer peripheral surface of the second electrode shaft at the external trigger arrangement area (TA): 2 mm <Inert Gas>

Type of Gas: xenon gas

Example 2

The short arc type flash lamp according to the second embodiment of the invention (hereinafter referred to as "flash lamp B") was fabricated according to the structure as shown in FIG. 6. This flash lamp B has the same specifications as the flash lamp A according to the example 1 except for the point as shown below, in the flash lamp A which was fabricated in the above example 1.

<Second Seal Tube Part 15>

Length of the space forming part for preliminary discharge 18 in the axial direction: 5 mm; Thickness: 2 mm; Dimension of the gap between the inner peripheral surface of the space forming part for preliminary discharge and the outer peripheral surface of the second electrode shaft: 5 mm Example 3

The short arc type flash lamp according to the third embodiment of the present invention (hereinafter referred to as "flash lamp C") was fabricated according to the structure as shown in FIG. 7. This flash lamp C has the same specifications as the flash lamp B according to the example 2 except for the point as shown below, in the flash lamp B which was fabricated in the above example 2.

<Second Seal Tube Part 15>

Minimum outer diameter of the space forming part for preliminary discharge 18: 10 mm; Dimension of the gap between the inner circumferential surface of the space forming part for preliminary discharge 18 and the outer peripheral surface of the second electrode shaft (minimum approach distance): 0.5 mm Comparative Example 1

Figure 9:
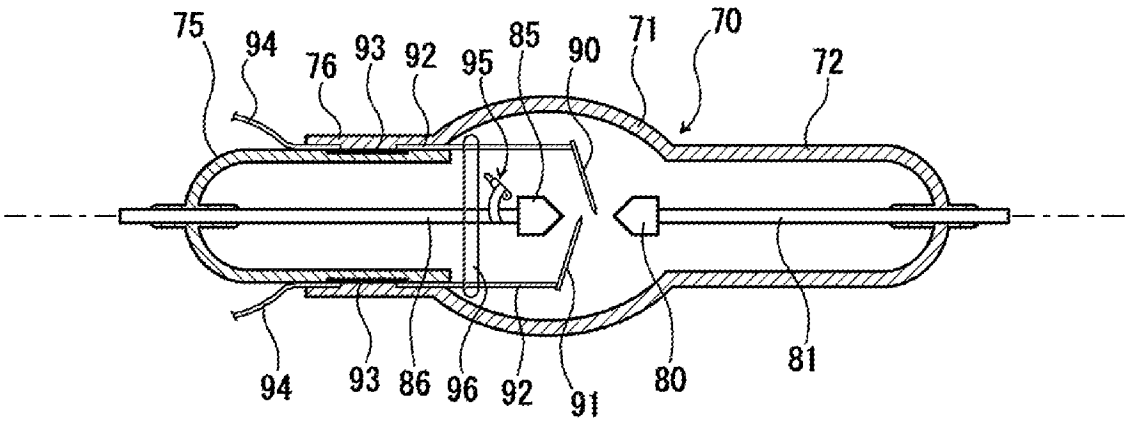
FIG. 9 is a cross-sectional view along the tube axis direction showing an outline of a structure in one example of a conventional short arc type flash lamp.

A short arc type flash lamp for comparison (hereinafter referred to as "flash lamp D") was fabricated by referring to the structure as shown in FIG. 9. This flash lamp D has the same structure as the flash lamp A according to the example 1 except that the sparker electrode is provided in place of the external trigger in the flash lamp A according to the example 1. In this configuration, however, the outer diameter of the starting auxiliary electrode sealing part 76 at the seal tube part on the cathode side was 47 mm.

Figure 8:
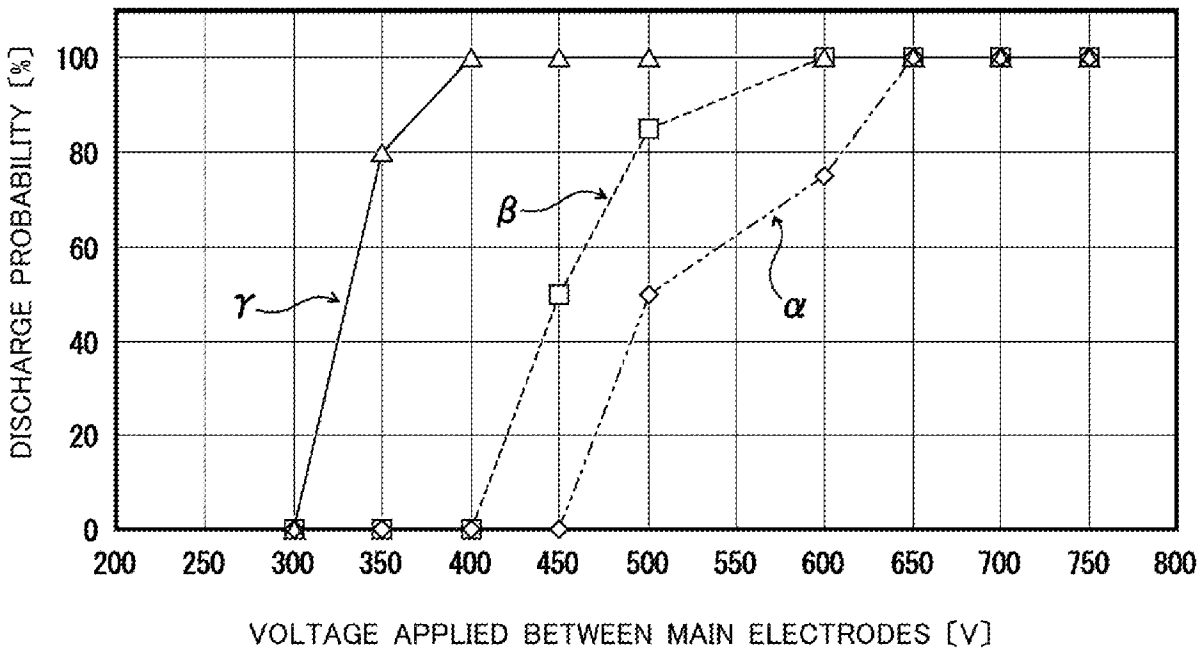
FIG. 8 is a graph illustrating a result of lighting tests of the short arc type flash lamp according to the embodiments fabricated according to the first to the third examples.

For each of the flash lamps A to C, lighting tests (luminous tests) were performed in which a lighting operation of 10 flash light emission (10 Hz) per second for 10 seconds (i.e., 100 times of the flash light emission) was performed by applying a voltage of 10 kV between the cathode and one starting auxiliary electrode, between the anode and the other starting auxiliary electrode, and between the pair of starting auxiliary electrodes, respectively, together with changing the voltage applied between the cathode and the anode (i.e., voltage applied between the main electrodes) as appropriate, and the discharge probability was studied. Here, the "discharge probability" was calculated by (frequency of light emission)/(number of voltage application). The results are shown in FIG. 8. In FIG. 8, the curve α which is shown by a two-dot chain line (diamond mark plots) is the result of the flash lamp A; the curve β which is shown by a broken line (square mark plots) is the result of the flash lamp B; and the curve γ which is shown by a solid line (triangle mark plots) is the result of the flash lamp C.

On the other hand, regarding the flash lamp D, when similar tests were performed, it was confirmed that with the applied voltage between the main electrodes of 500 V, flash discharge occurred with the discharge probability of 50%, and with the applied voltage between the main electrodes of greater than or equal to 650 V, flash discharge occurred with the discharge probability of 100%.

From the above results, it was confirmed that the flash lamp that has the equivalent lamp starting performance (startability) with that of the flash lamp D composed with the trigger electrode inside the bulb can be obtained as one with a narrower seal tube part.

Also, generally, in a flash lamp, if the applied voltage between the main electrodes that is necessary for stable discharge is high, it becomes difficult to obtain an intended lamp life. For example, when the applied voltage between the main electrodes is greater than or equal to 700 V, the illuminance maintaining rate decreases down to a degree of 70% with the time of 100 hours or below. Therefore, the flash lamp that can stably discharge with a lower applied voltage between the main electrodes is desired. In this regard, with the flash lamp B and the flash lamp C, it was confirmed that stable discharge (flash lighting) was possible with the low applied voltage between the main electrodes of 600 V or below. And in the flash lamp B and the flash lamp C, it was also confirmed that the time in which the illuminance maintaining rate decreases down to a degree of 70% (the lamp life) was greater than or equal to 200 hours.

The embodiments of the present invention have been explained in the above, but the invention is not limited to the above embodiments and various modifications are possible.

For example, in the flash lamp according to the first embodiment, it may have a structure in which a recessed portion is formed on the starting auxiliary electrode sealing part to extend on its whole circumference and the external trigger is provided in such a recessed portion. With such a structure, it is possible to generate discharge between the main electrodes stably with a lower applied voltage between the main electrodes, and higher lamp starting performance (startability) can be obtained.

While certain embodiments have been described, these embodiments have been presented by way of example only, and are not intended to limit the scope of the present invention. The novel devices, apparatuses and methods thereof described herein may be embodied in a variety of other forms. Furthermore, various omissions, substitutions, modifications and changes in the form of the devices, apparatuses and methods thereof described herein may be made without departing from the gist of the present invention. The accompanying claims and their equivalents are intended to cover such forms of modifications as would fall within the scope and gist of the present invention.

The present application is based upon and claims the benefit of a priority from Japanese Patent Application No.

2014-037844, filed Feb. 28, 2014, and the entire content of this Japanese Patent Application is incorporated herein by reference.

What is claimed is:

1. A short arc type flash lamp of a double end type, comprising:

a glass bulb including:

an arc tube part having a substantially spherical shape;

a first seal tube part extending outward along the tube axis direction to be continuous from one end of the arc tube part; and a second seal tube part extending outward along the tube axis direction to be continuous from the other end of the arc tube part, the first and second seal tube parts each having a straight tube shape and a smaller outer diameter than the arc tube part, a pair of main electrodes being arranged facing each other inside the arc tube part, and a pair of starting auxiliary electrodes being arranged inside the arc tube part;

a gap being provided in an inner circumference of the second seal tube part; and a reduced diameter portion being formed on an outer peripheral surface of the second seal tube part corresponding to the gap in a circumferential direction, an electrode shaft of one of the main electrodes being sealed in the first seal tube part and led out air-tightly from the first seal tube part, and an electrode shaft of the other of the main electrodes and leads for the starting auxiliary electrodes respectively being sealed in the second seal tube part and led out from the second seal tube part, an external trigger being disposed in the reduced diameter portion by winding a wire in the circumferential direction on the outer peripheral surface of the second seal tube part, and the external trigger triggering preliminary discharge that occurs in the gap of the second seal tube part between the external trigger disposed in the reduced diameter portion of the second seal tube part and the electrode shaft of the other of the main electrode sealed in the second seal tube part, the preliminary discharge occurring prior to a main discharge occurring in the arc tube part.

2. The short arc type flash lamp according to claim 1, wherein a thickness of the second seal tube part on which the external trigger is disposed is smaller than a thickness of the second seal tube part on which the external trigger is not disposed.

3. The short arc type flash lamp according to claim 2, wherein an outer diameter of the second seal tube part on which the external trigger is disposed is smaller than an outer diameter of the second seal tube part on which the external trigger is not disposed.

4. A light source device, comprising:

the short arc type flash lamp according to claim 1; and a concave reflection mirror made with a parabolic mirror or an ellipsoidal reflection mirror, wherein the concave reflection mirror is disposed on the second seal tube part side of the short arc type flash lamp in a state in which a focal point of the concave reflection mirror coincides with a luminous point of the short arc type flash lamp.

5. A light source device, comprising:

the short arc type flash lamp according to claim 2; and a concave reflection mirror made with a parabolic mirror or an ellipsoidal reflection mirror, wherein the concave reflection mirror is disposed on the second seal tube part side of the short arc type flash lamp in a state in which a focal point of the concave reflection mirror coincides with a luminous point of the short arc type flash lamp.

6. A light source device, comprising:

the short arc type flash lamp according to claim 3; and a concave reflection mirror made with a parabolic mirror or an ellipsoidal reflection mirror, wherein the concave reflection mirror is disposed on the second seal tube part side of the short arc type flash lamp in a state in which a focal point of the concave reflection mirror coincides with a luminous point of the short arc type flash lamp.

7. The short arc type flash lamp according to claim 1, wherein the second seal tube part on which the external trigger is disposed has a straight tube shape.

8. The short arc type flash lamp according to claim 1, wherein each of the starting auxiliary electrodes is capable of carrying out preliminary discharge with each of the main electrodes.

9. A light source device, comprising:

the short arc type flash lamp according to claim 7; and a concave reflection mirror made with a parabolic mirror or an ellipsoidal reflection mirror, wherein the concave reflection mirror is disposed on the second seal tube part side of the short arc type flash lamp in a state in which a focal point of the concave reflection mirror coincides with a luminous point of the short arc type flash lamp.

10. A light source device, comprising:

the short arc type flash lamp according to claim 8; and a concave reflection mirror made with a parabolic mirror or an ellipsoidal reflection mirror, wherein the concave reflection mirror is disposed on the second seal tube part side of the short arc type flash lamp in a state in which a focal point of the concave reflection mirror coincides with a luminous point of the short arc type flash lamp.

* * * * *